US011326410B2

(12) United States Patent
Wutherich

(10) Patent No.: US 11,326,410 B2
(45) Date of Patent: May 10, 2022

(54) ORIENTING SUB FOR WELL INSTRUMENTS

(71) Applicant: Kevin David Wutherich, Bixby, OK (US)

(72) Inventor: Kevin David Wutherich, Bixby, OK (US)

(73) Assignee: Frac Innovation LLC, Sewickley, PA (US)

( * ) Notice: Subject to any disclaimer, the term of this patent is extended or adjusted under 35 U.S.C. 154(b) by 0 days.

(21) Appl. No.: 16/816,342

(22) Filed: Mar. 12, 2020

(65) Prior Publication Data

US 2020/0208480 A1 Jul. 2, 2020

Related U.S. Application Data

(60) Provisional application No. 62/922,226, filed on Sep. 29, 2019, provisional application No. 62/818,438, filed on Mar. 14, 2019.

(51) Int. Cl.

| | |
|---|---|
| ***E21B 23/00*** | (2006.01) |
| ***E21B 23/03*** | (2006.01) |
| ***E21B 47/024*** | (2006.01) |

(52) U.S. Cl.

CPC ..... *E21B 23/00* (2013.01); *E21B 23/03* (2013.01); *E21B 47/024* (2013.01)

(58) Field of Classification Search

CPC ..... E21B 23/03; E21B 23/00; E21B 47/024

See application file for complete search history.

(56) References Cited

U.S. PATENT DOCUMENTS

| | | | | |
|---|---|---|---|---|
| 4,438,810 | A | 3/1984 | Wilkinson | |
| 4,553,310 | A * | 11/1985 | Logan | B23P 15/00 166/117.5 |
| 4,606,410 | A * | 8/1986 | Becker | E21B 23/03 166/117.5 |
| 5,040,619 | A | 8/1991 | Jordan et al. | |
| 5,107,927 | A * | 4/1992 | Whiteley | E21B 17/10 166/227 |
| 5,137,085 | A * | 8/1992 | Goode | E21B 23/03 166/117.5 |
| 6,679,327 | B2 | 1/2004 | Sloan et al. | |
| 9,903,185 | B2 * | 2/2018 | Ursi | E21B 43/119 |

FOREIGN PATENT DOCUMENTS

| | | |
|---|---|---|
| GB | 2390623 A | 1/2004 |

OTHER PUBLICATIONS

Swivel Joints, Wireline Equipment Catalogue v.3.2 | Slickline Tools, retrieved from the internet www.hunting-intl.com, year 2020, 1 page.

* cited by examiner

*Primary Examiner* — Cathleen R Hutchins
(74) *Attorney, Agent, or Firm* — Thomas M. Joseph, Esq

(57) ABSTRACT

An orientation sub includes a pair of connectors that consists of a first connector and a second connector with the first connector. A center section joins the first connector to the second connector. The second connector connects the orientation sub to a tool. The center section has a predetermined geometric configuration with that self-orients the tool when the orientation sub and the tool are inserted into a well defined by casing.

20 Claims, 8 Drawing Sheets

ORIENTING SUB FOR WELL INSTRUMENTS

CROSS REFERENCE TO RELATED APPLICATION

This application claims the benefit under 35 U.S.C. § 119(e) of U.S. Provisional Application No. 62/818,438 entitled "PERFORATION ORIENTATION USING ECCENTERED SUB" filed Mar. 14, 2019, and U.S. Provisional Application No. 62/922,226 entitled "PERFORATION ORIENTATION USING ECCENTERED SUB" filed Sep. 29, 2019, which are incorporated herein by reference.

BACKGROUND

The drilling of wells and, in particular, hydrocarbon wells can involve complications that make the process time consuming and expensive. In recognition of these complications and expenses, added emphasis has been placed on increasing efficiencies associated with drilling operations. Over the years, ever increasing well depths and sophisticated well architectures have made the need to obtain reductions in time and effort spent in drilling wells even greater. Orienting tooling mounted on toolstrings during perforating and fracturing operations in a cased well constitutes an area where significant amounts of time and effort are spent.

An exemplary conventional toolstring arrangement, generally designated by the numeral 10, of a hydrocarbon well tooling assembly is shown in FIGS. 1-3. The toolstring arrangement 10 includes an eccentered weight bar (EWB) 12 connected to a perforation gun assembly 14. The EWB 12 is adjacent to the perforation gun assembly 14 and aligned along a horizontal line. A wireline connector 16 is adjacent to the EWB 12 and positioned at one end of the toolstring arrangement 10. A plug setting tool 18 is adjacent to the perforation gun assembly 14 at the opposite end of the toolstring arrangement 10.

The perforation gun assembly 14 includes a perforation gun 20 positioned between a pair of tandem subs 22-24. The perforation gun 20 holds a charge therein. The tandem sub 24 is adjacent to plug setting tool 18 within the toolstring arrangement 10. The perforation gun assembly 14 further includes a connector 26 that is adjacent to the tandem sub 22. In arrangements that do not include the EWB 12, the connector 26 can be replaced with a swivel/disconnect or other similar connector.

The placement of the EWB 12 relative to the perforation gun assembly 14 lowers the center of gravity of the toolstring arrangement 10 in a relatively effective and cost-efficient manner. Additional perforation guns can be added to the toolstring arrangement 10. However, as more perforation guns are added to the toolstring arrangement 10, the EWB 12 becomes less effective and less efficient. This is due to the fact that the additional perforation gun actually raises the center of gravity of the toolstring arrangement 10.

The EWB 12 become less effective at lowering the center of gravity as additional perforation gun assemblies are added to the toolstring arrangement 10. Additionally, the EWB 12 adds considerable length and weight to the toolstring arrangement 10, which increases the length of lubricator that must be used. Moreover, as the length of the toolstring arrangement 10 increases the amount of decrease in the center of gravity that an EWB can provide decreases. The effectiveness of using the above-described conventional toolstring arrangement 10 is poor with orientation accuracy being in the range of +/−30 deg or more.

More complicated, expensive conventional tooling arrangements are known. Such systems, typically, use some form of internal ball bearings systems and weights to ensure a more accurate orientation. Two exemplary tooling arrangements, generally designated by the numerals 28-30, are shown in FIGS. 4-5.

An example of tooling arrangement 28 is the GFORCE® precision perforation orientation system. GFORCE® is a registered trademark of Haliburton Company of Houston, Tex. An example of tooling arrangement 30 is the SNIPER® orientation perforation system. SNIPER® is a registered trademark of GEODynamics, Inc. of Millsap, Tex.

The tooling arrangement 28 includes an internal ball bearing and/or weight system 32 to alter the center of gravity of the system. The tooling arrangement 30 includes an essentially cylindrical, tubular perforation gun 34 that can be rotated either clockwise or counterclockwise 36 within a well 38. The perforation gun 34 can rotate about a pivot point 40 to lower the center of gravity 42 along a vertical direction 44.

The problem with these conventional systems 28-30 is that such system can have a significantly higher cost and can often limit the size of the perforation charges being used. For these reasons, there is a need for improved devices to orient tooling on toolstring within a hydrocarbon well.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, an orientation sub can be deployed within a well defined by casing. The orientation sub and an offset operating tool form an offset tool assembly. The offset tool assembly connects to a centered tool assembly. An elongated tubular body holds the tool within the well in a predetermined orientation when the offset tool assembly is deployed within the well. The elongated tubular body has a first tubular connecting section adapted to connect to a centered tool assembly, a second tubular connecting section adapted to connect to an offset operating tool, and a center section connecting the first tubular connecting section to the second tubular connecting section. The center section has a predetermined geometric configuration that self-orients the offset operating tool when the offset tool assembly is inserted into the well.

In other implementations, a self-orienting orientation sub for orienting a tool when the tool is deployed in a well defined by casing is provided. A pair of connectors consists of a first connector and a second connector. A center section joins the first connector to the second connector. The second connector connects the orientation sub to the tool. The center section has a predetermined geometric configuration that self-orients the tool when the orientation sub and the tool are inserted into the well.

These, and other features and advantages, will be apparent from a reading of the following detailed description and a review of the appended drawings. It is to be understood that the foregoing summary, the following detailed description and the appended drawings are explanatory only, and are not restrictive of various aspects as claimed.

DETAILED DESCRIPTION

Figure 1:
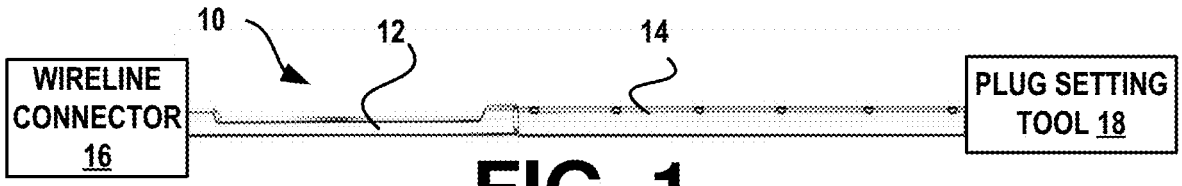
FIG. 1 (Prior Art)
FIG. 1 is a perspective side view of a toolstring assembly found in the prior art.
Figure 2:
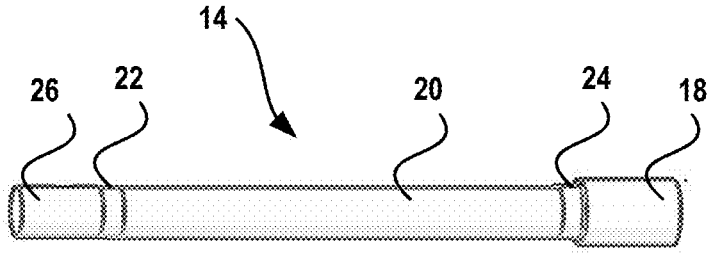
FIG. 2 (Prior Art)
FIG. 2 is a perspective side view of a perforation gun assembly found in the prior art.
Figure 3:
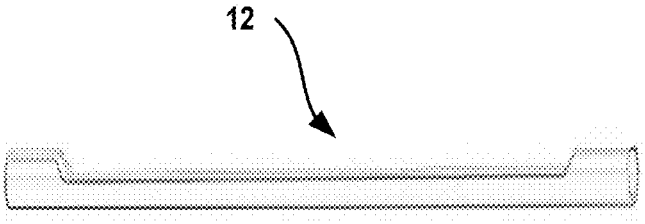
FIG. 3 (Prior Art)
FIG. 3 is a perspective side view of an EWB found in the prior art.
Figure 4:
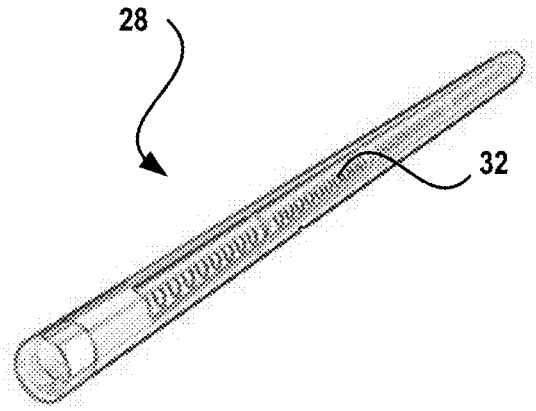
FIG. 4 (Prior Art)
FIG. 4 is a perspective side view of another perforation gun assembly found in the prior art.
Figure 5:
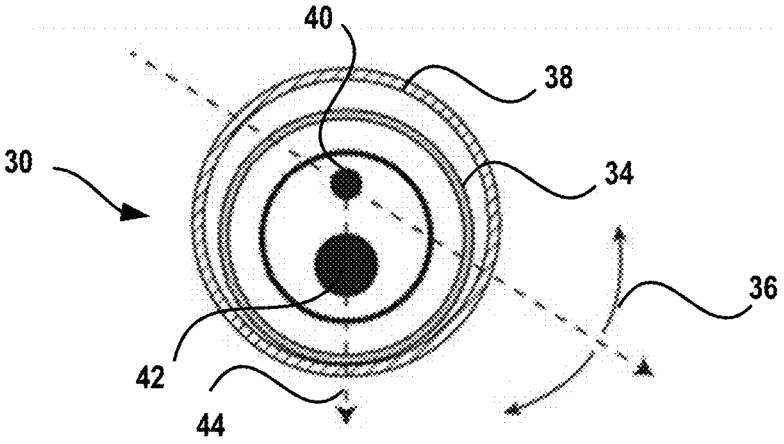
FIG. 5 (Prior Art)
FIG. 5 is a schematic diagram of another perforation gun assembly found in the prior art.

The subject disclosure is directed to an orientation device. More specifically, the subject disclosure is directed to orientation sub for orienting a tool for deployment on a wire line in a well defined by casing. Exemplary tooling includes perforation guns for use in hydraulic fracturing and other operations in the oil and gas industry. The orientation sub has a center section with a predetermined geometric configuration that self-orients the tool when the perforation guns are inserted into the well. In some embodiments, the orientation sub can be utilized with phased perforation guns and oriented perforation guns. The perforation guns can be phased with the holes being set forth at varying degrees or oriented with the holes aligned in a single direction.

The predetermined geometric configuration of the center section, in some embodiments, can be asymmetric, offset configuration that lowers the center of gravity of the portion of the wire line that includes the perforation guns and the orientation sub. In other embodiments, the center section can have a symmetric, oval cross-sectional profile.

The detailed description provided below in connection with the appended drawings is intended as a description of examples and is not intended to represent the only forms in which the present examples can be constructed or utilized. The description sets forth functions of the examples, and sequences of steps for constructing and operating the examples. However, the same, or equivalent, functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic but every embodiment, implementation or example need not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

Referring now to FIGS. 6-10, there is shown an orientation tool system, generally designated by the numeral 100, that is particularly adapted for self-orienting a plurality of operating tools 110-112 within a well that is defined by casing. The orientation tool system 100 can be deployed to connect to a toolstring or a wire line 114 within the well. The orientation tool system 100 includes the operating tools 110-112, an orientation sub 116, and an adapter 118, and a setting tool 120. In this exemplary embodiment, the operating tools 110-112 and the orientation sub 116 form an offset tool assembly. The adapter 118 and the setting tool 120 form a centered tool assembly (or "non-offset" tool assembly). The center of gravity of the orientation tool system 100 is lowered by positioning the operating tools 110-112 in an offset position in relation to the toolstring 114 with the orientation sub 116.

The orientation sub 116 includes an elongated tubular body 122 for mounting the operating tools 110-112 on the wire line 114. Specifically, the elongated tubular body 122 connects to the operating tool 112 to hold the operating tools 110-112 in a predetermined orientation within the well. The connection can be releasable.

The elongated tubular body 122 includes tubular connecting section or connector 124, tubular connecting section or connector 126, and a center section 128 that connects tubular connecting section 124 to tubular connecting section 126. The tubular connecting section 124 is adapted to couple and/or to connect the orientation sub 116 to the adapter 118, which connects to the plug setting tool 120. The connecting section 124 is adapted to connect the orientation sub 116 to the operating tool 110. The outer diameter of the tubular connecting section 126 is substantially larger than the outer diameter of the tubular connecting section 124.

The center section 128 has a predetermined geometric configuration that self-orients the operating tools 110-112 when the orientation tool system 100 is inserted into the well. Specifically, the center section 128 has an offset tapered profile that lowers the center of mass of the orientation tool system 100 when the orientation tool system 100 is inserted into the well. As a result of the offset tapered profile, the center of mass of the orientation tool system 100 is closer to lower surface 130 than the upper surface 132 when the orientation tool system 100 is assembled.

The tubular connecting sections 124-126 and the center section 128 can be integral in some embodiments. In other embodiments the tubular connecting sections 124-126 and the center section 128 can be unitary. In some embodiments, the tubular connecting section 124 forms an offset nipple that is sufficiently eccentered, so that the connection with operating tool 112 is flush.

The center line of each tubular connecting section 124-126 is offset from one another, due to the geometry of the center section 128. As a result, the tubular connecting section 126 can hold the operating tools 110-112 in an offset position. When the operating tools 110-112 are in the offset position, the center of mass of the orientation tool system 100 is closer to the lower surface 130, which orients the orientation tool system 110 in a manner that causes the lower surface 130 to move toward the bottom of the well through the assistance of gravity, thereby providing a self-orienting property to the orientation tool system 110.

Figure 6:
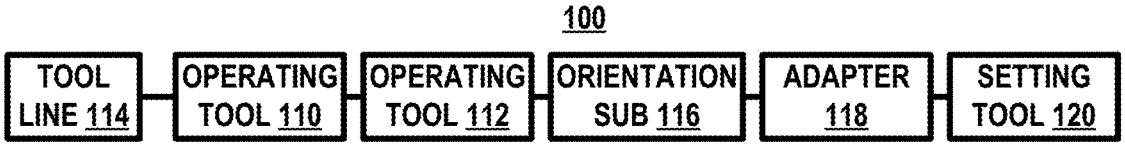
FIG. 6 is a block diagram of an orientation sub assembly in accordance with this disclosure.
Figure 7:
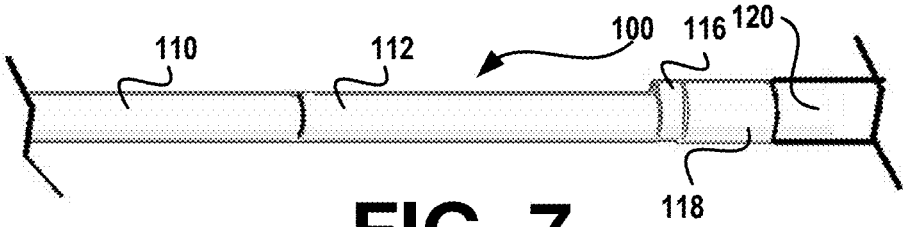
FIG. 7 is a fragmentary perspective view of the orientation sub assembly shown in FIG. 6.

As shown in FIGS. 6-7, the operating tools 110-112 can be perforation guns, the adapter 118 can be a plug setting adapter, and the setting tool 120 can be a plug setting tool. The self-orienting property of the orientation tool system 100 in such applications can be used to increase perforations and perforation efficiency when the operating tools 110-112 perform operations in the well.

As progress has been made with respect to an understanding of wellbore stresses and stress patterns, the effect of such stresses on perforation efficiency are becoming known, particularly with respect to a 60 degree phased design. Phases within the range of zero degree (up) to 180 degree (down) (i.e., 0-180) are becoming much more common as the number of clusters per stage increases and the number of perforations per cluster decreases. The ideal situation would be to have all perforations aligned in the plane of least stress, which is at 0-180 degrees.

In other embodiments, the operating tools 110-112 can be swivels, plug-shoot adapters, wireline disconnects, centralizers, sensors, detectors, other similar device or any combination thereof. The adapter 118 and/or the setting tool 120 can be replaced with a any of the above-described operating tools, such as plug-shoot adapters, wireline disconnects, centralizers, sensors, detectors, and/or other similar device. Further, it should be understood that the orientation tool system 100 can be used with EWBs, despite the fact that the orientation tool system 100 is designed to replace conventional EWBs.

Figure 8:
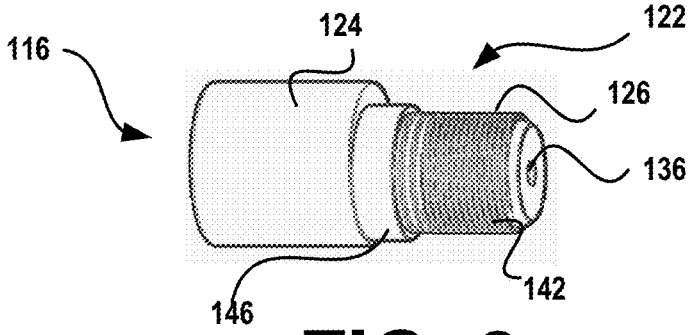
FIG. 8 is a perspective view of an orientation sub in accordance with this disclosure.
Figure 9:
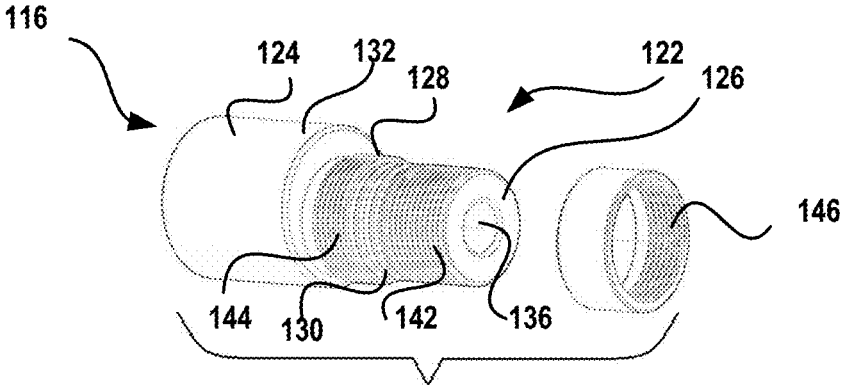
FIG. 9 is an exploded perspective view of an orientation sub in accordance with this disclosure.
Figure 10:
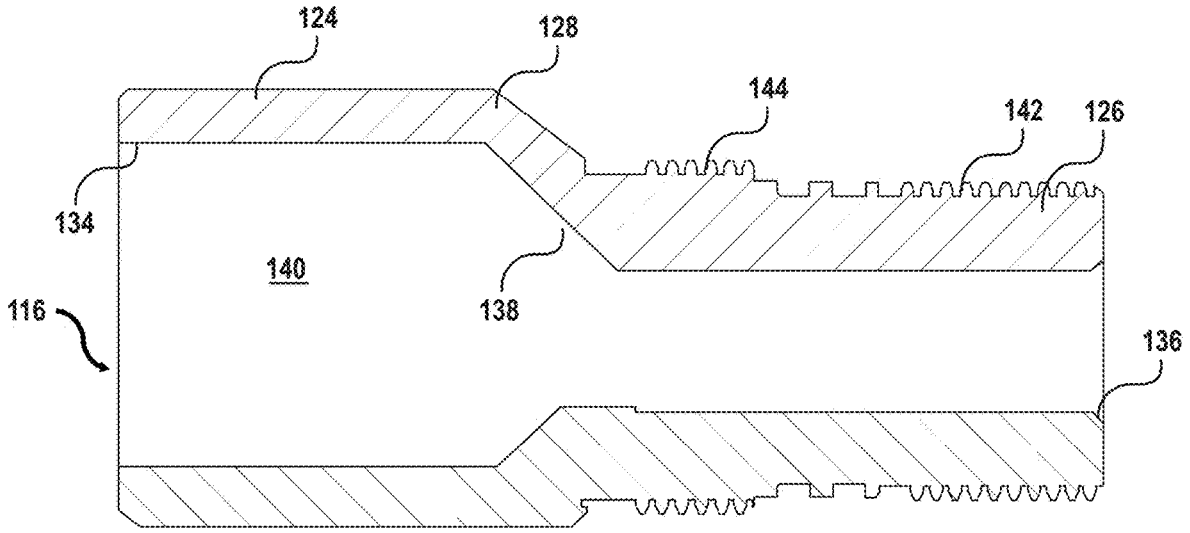
FIG. 10 is a cross section view in side elevation of an orientation sub in accordance with this disclosure.

As shown in FIGS. 8-10, the elongated tubular body 122 has a pair of openings 134-136 positioned at opposite ends. An internal bore 138 connects the openings 134-136, so that can be in fluid communication with one another. The internal bore 138 can form a threaded receptacle 140.

In this exemplary embodiment, the tubular connecting section 124 has an essentially cylindrical outer configuration that defines a female connector. The tubular connecting section 126 has an essentially cylindrical outer configuration that defines a male connector. In some embodiments, the tubular connecting section 126 can be electrically connected to the operating tool 112 when the orientation tool system 100 is assembled.

The tubular connecting sections 124-126 can have essentially cylindrical configurations and project outwardly from opposite sides of the elongated body 122. In some embodiments, the tubular connection sections 124-126 form male connectors with the tubular connection section 124 inserting into the adapter 118 to arrange the orientation tool system 100 in the offset position. In other embodiments, the tubular connecting sections 124-126 can be configured to form female connectors or to form mixed pairs of male and female connectors. Additionally, the elongated tubular body 122 can have an outer geometry or configuration of an eccentered sub, a tandem sub, a tandem eccentered sub, an oriented tandem sub, and/or a ported sub.

The tubular connection section 124 and the center section 128 have threaded outer surfaces 142-144. The threaded surface 142 can facilitate connection of the oriented sub 116 to the operating tool 112. The threaded surface 144 can connect to a lock ring 146 that can hold the operating tools 110-112 in a predetermined position. In some embodiments, the lock ring 146 can be replaced or supplemented by other mechanisms that maintain the offset orientation of the operating tools 110-112 in a fixed position within the orientation tool system 100 and relevant to the wire line 114.

The lock ring 146 connects to an outer surface of the central section 128 through a threaded connection. The lock ring 146 locks the orientation of the operating tools 110-112. In some embodiments, the lock ring 146 is advanced on the threaded outer surface of the central section 128 at an initial position. Then, the lock ring 146 is backed off until the operating tools 110-112 are pointing in the desired orientation. Once the operating tools 110-112 are oriented correctly, the lock ring 146 is tightened up against the operating tools 110-112 to hold the orientation firmly.

It should be understood that one or more O-rings can be placed over the threaded outer surfaces 142-144 when the orientation tool system 100 is assembled. The O-rings can be made from plastics that include one or more of thermoplastics, thermosets, network polymers, rubbers, thermoplastic elastomers, and/or plastomers.

In some embodiments, the tubular connecting section 126 can form a nipple. In such embodiments, the threaded outer surface 142 can contain standard threads that connect to the operating tool 112.

The orientation tool system 100 and its component parts can be made of any suitable material using any suitable manufacturing process. Some embodiments can utilize wear grooves that indicate when an orienting sub (i.e., tubular connection section 124) is worn to a point that the lock ring 146 will begin to wear. Additional grooves or channels can be made to the structure to reduce the mass of the orientation tool system 100.

Other embodiments can include indicators on the operating tool 112 to determine the orientation of the operating tool 112. Some embodiments can include bearings and/or wheels that reduce friction induced wear that is caused by turning within a casing. In other embodiments, the operating tool 112 can include a lug or a fin attached to a central hub to enhance orientation. The orientation tool system 100 can include an electrical, electronic, or mechanical device that verifies orientation.

Figure 11:
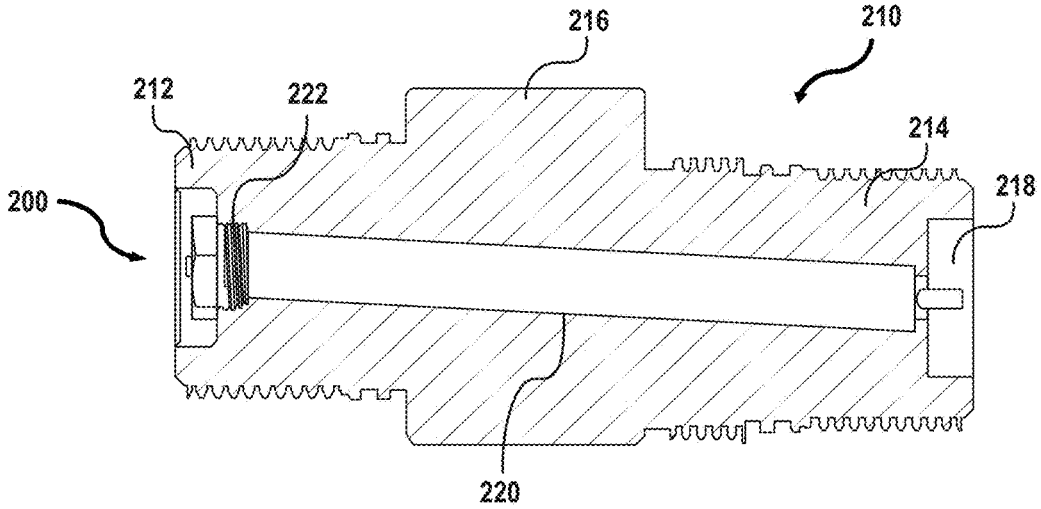
FIG. 11 is a cross section view in side elevation of another embodiment of an orientation sub in accordance with this disclosure.

Referring now to FIG. 11 with continuing reference to the foregoing figures, there is shown another embodiment of an orientation sub, generally designated by the numeral 200. Like the embodiment shown in FIGS. 6-10, the orientation sub 200 includes an elongated body 210, a pair of tubular connecting sections 212-214, and a tubular center section 216. The tubular connecting sections 212-214 are male connectors, so that the orientation sub 200 has a male-male configuration.

The elongated body 210 includes an internal bore 218 and a switch assembly 220 mounted therein. The switch assembly 220 is conductive path, such as a metal rod or wire that are insulated from touching a metal tool body. The switch assembly 220 can have a predetermined outer configuration that requires the switch assembly 220 to have a predetermined orientation (or set of orientations) before insertion into a cavity within a receptacle 222. In this exemplary embodiment, the switch assembly 220 has an elliptical shaped body and the cavity is elliptical, so that the switch assembly 220 can be inserted into the cavity only in two directions.

Figure 12:
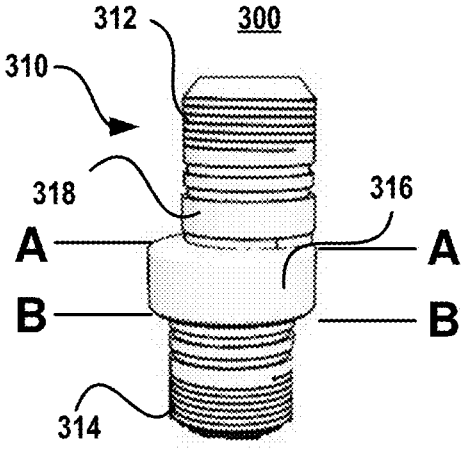
FIG. 12 is a perspective side view of another embodiment of an orientation sub in accordance with this disclosure.
Figure 13:
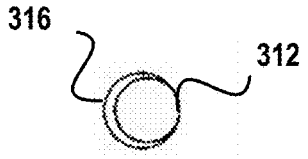
FIG. 13 is a cross section view in side elevation along A-A shown in FIG. 12.
Figure 14:
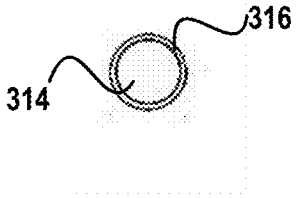
FIG. 14 is a cross section view in side elevation along B-B shown in FIG. 12.

Referring now to FIGS. 12-14 with continuing reference to the foregoing figures, there is shown another embodiment of an orientation sub, generally designated by the numeral 300. Like the embodiments shown in FIGS. 6-10, the orientation sub 300 includes an elongated body 310, a pair of tubular connecting sections 312-314, a tubular center section 316, and a lock ring 318.

The tubular connecting sections 312-314 have essentially cylindrical outer configurations that define male connectors. The center line of each connecting section 312-314 is misaligned with one another. In some embodiments, the tubular connecting section 316 can have an outer diameter ("OD") that is larger than an operating tool, such as the operating tool 112 shown in FIGS. 6-10. In other embodiments, the tubular connecting section 316 can have portions that have a diameter equal to the casing diameter of the operating tool 112 shown in FIGS. 6-10. In other embodiments, the tubular connecting section 316 can include portions that are flat, portions that are relatively flat, and/or a tapered profile. The tubular connecting section 316 can have lengths ranging from under 1 inch to over 8 inches.

The tubular connecting section 312 can have an outer diameter that is at least as wide as the largest outer diameter of the wire line 114. In one exemplary embodiment, the tubular connecting section 316 has the same OD as the OD of a Baker 20 plug setting tool, which is provided by BakerHughes of Houston, Tex. The OD of the Baker 20 plug setting tool is 3.8 inches.

Figure 15:
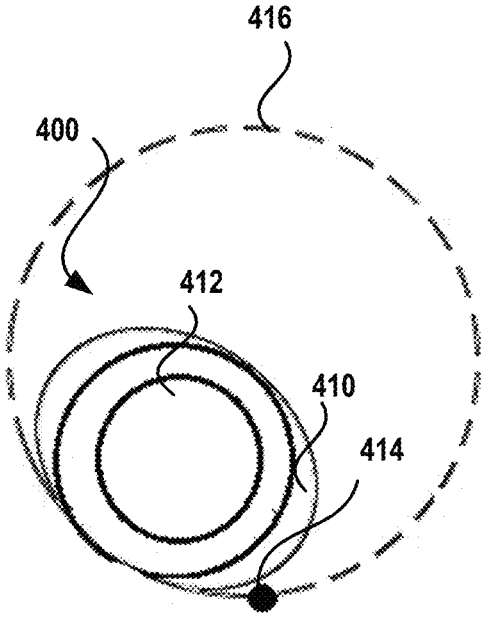
FIG. 15 is a schematic diagram of the pre-orientation configuration of another embodiment of an orientation sub in accordance with this disclosure.
Figure 16:
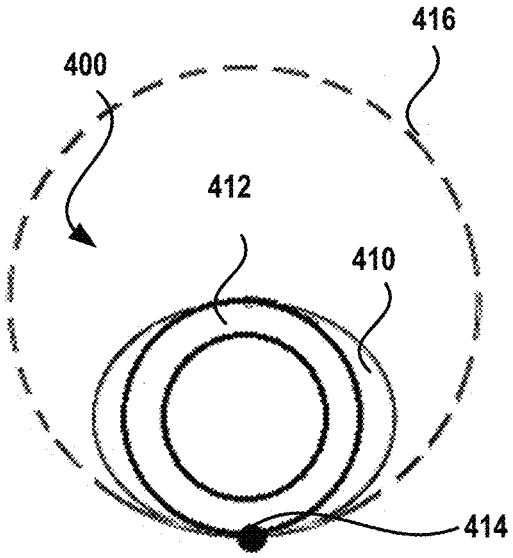
FIG. 16 is a schematic diagram of the oriented orientation sus shown in FIG. 15 in accordance with this disclosure.

Referring now to FIGS. 15-16 with continuing reference to the foregoing figures, there is shown another embodiment of an orientation tool system, generally designated by the numeral 400. Like the embodiments shown in FIGS. 6-10, the orientation tool system 400 includes an orientation sub 410 and an operating tool 412.

The orientation sub 410 has elliptic cylinder outer configuration with an essentially oval profile that is particularly adapted to orient symmetrical perforations, such as perforations that include 90 degree phasing or 180 phasing, but not perforations that include 0 degree phasing. The elliptical profile ensures that the orientation tool system 400 will be self-orienting to drive the orientation tool system 400 towards the lowest point 414 of the well 416.

Figure 17:
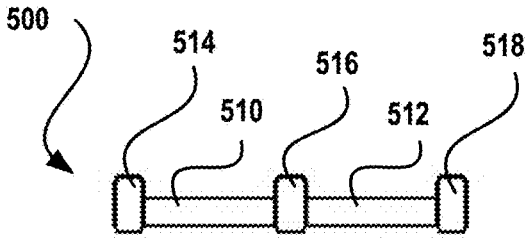
FIG. 17 is a perspective side view of a schematic diagram of another embodiment of an orientation tool system in accordance with this disclosure.

Referring now to FIG. 17 with continuing reference to the foregoing figures, there is shown another embodiment of an orientation tool system, generally designated by the numeral 500. Like the embodiment shown in FIGS. 6-10, the orientation tool system 500 includes a pair of operating tools 510-512 that can include a perforation gun in certain applications. The operating tools 510-512 are positioned between a plurality of orientation subs 514-518.

Figure 18:
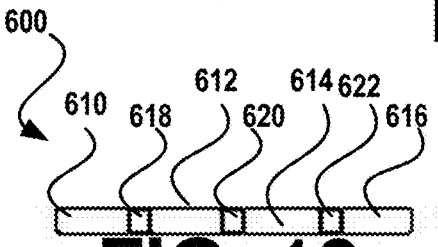
FIG. 18 is a perspective side view of a schematic diagram of another embodiment of an orientation tool system in accordance with this disclosure.
Figure 19:
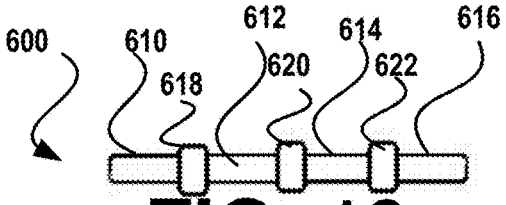
FIG. 19 is a perspective top view of a schematic diagram of the embodiment shown in FIG. 18.

Referring now to FIGS. 18-19 with continuing reference to the foregoing figures, there is shown another embodiment of an orientation tool system, generally designated by the numeral 600. The orientation tool system 600 includes a plurality of orientation tools 610-616 positioned between a plurality of orientation subs 618-622.

Figure 20:
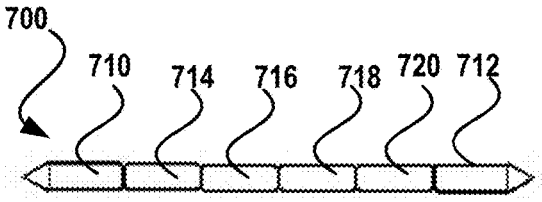
FIG. 20 is a perspective side view of a schematic diagram of another embodiment of an orientation tool system in accordance with this disclosure.
Figure 21:
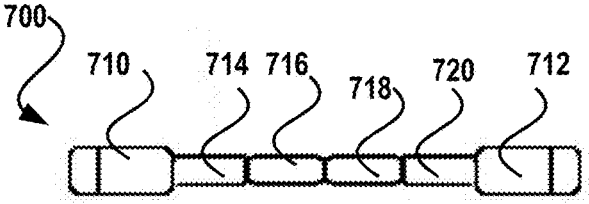
FIG. 21 is a perspective top view of a schematic diagram of the embodiment shown in FIG. 20.

Referring now to FIGS. 20-21 with continuing reference to the foregoing figures, there is shown another embodiment of an orientation tool system, generally designated by the numeral 700. Like the embodiment shown in FIGS. 6-10, the orientation tool system 700 can include a perforation gun in certain applications.

Unlike the embodiment shown in FIGS. 6-10, the orientation tool 700 includes orientation subs 710-712 that include operating tools 714-720 arranged in a head-to-tail configuration.

Figure 22:
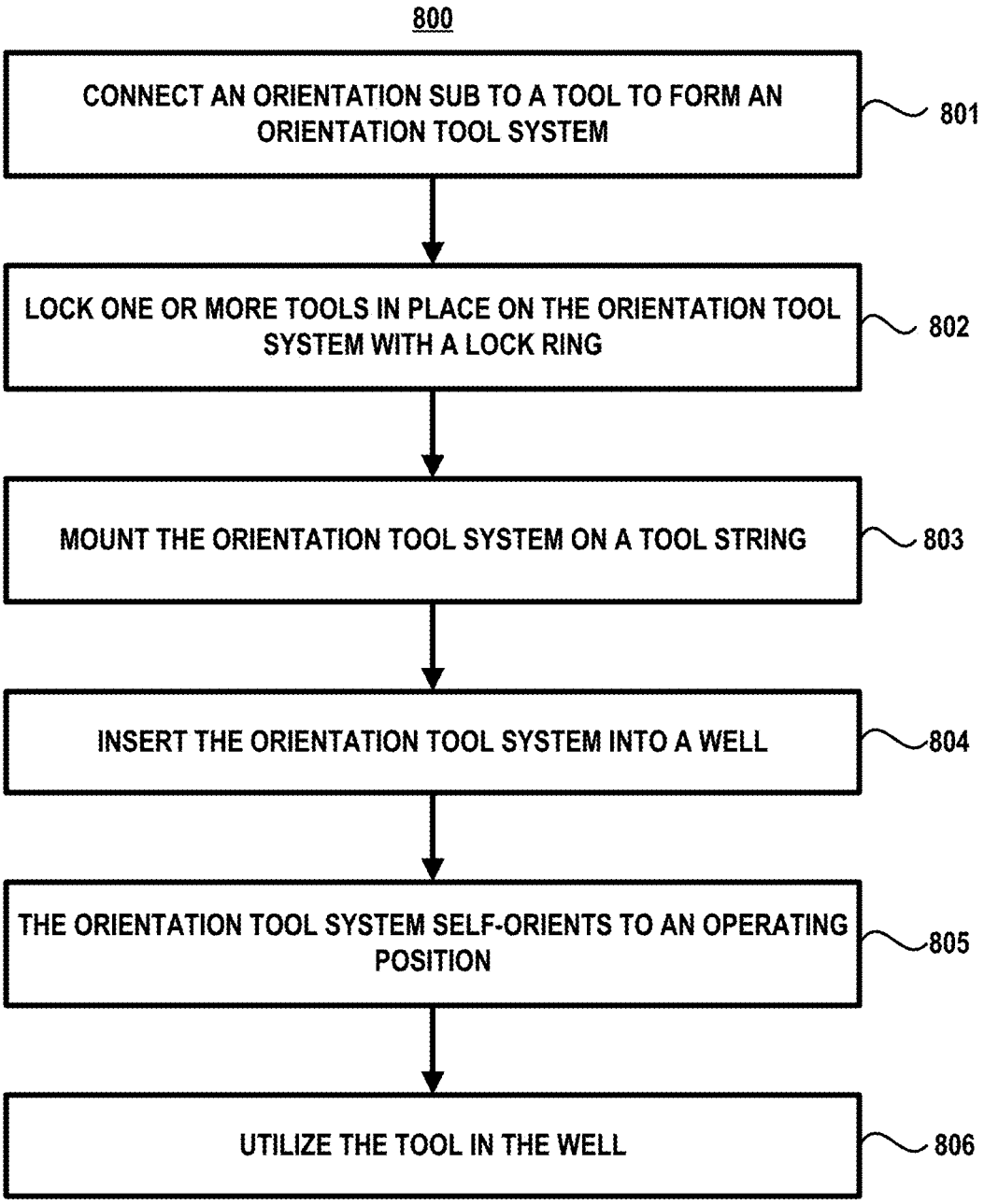
FIG. 22 is an exemplary process in accordance with this disclosure.

Referring to FIG. 22 with continuing reference to the foregoing figures, a method 800 for deploying a self-orienting tool assembly in a well defined by casing in accordance with the described subject matter is shown. Method 800, or portions thereof, can be performed using an orientation tool system, such as the orientation tool system 100 shown in FIGS. 6-10 and/or the orientation tool system 400 shown in FIGS. 15-16.

In some embodiments, the orientation tool system can include the orientation sub 200 shown in FIG. 10 or the orientation sub 300 shown in FIGS. 12-14. The method 800 can be used with the more complicated tooling configurations, such as orientation tool system 500 shown in FIG. 17, orientation tool system 600 shown in FIGS. 18-19, and orientation tool system 700 shown in FIGS. 20-21.

At 801, an orientation sub is connected to a tool to form an orientation tool system. In this exemplary embodiment, the orientation sub can be the orientation sub 116 shown in FIGS. 6-10, the orientation sub 200 shown in FIG. 11, the orientation sub 300 shown in FIGS. 12-14, the orientation sub 410 shown in FIGS. 15-16, one or more of the orientation subs 514-518 shown in FIG. 17, one or more of the orientation subs 618-620 shown in FIGS. 18-19, and/or one or more of the orientation subs 710-712 shown in FIGS. 20-21.

The orientation tool system can be the orientation tool system 100 shown in FIGS. 6-10, the orientation tool system 400 shown in FIGS. 15-16, the orientation tool system 500 shown in FIG. 17, orientation tool system 600 shown in FIGS. 18-19, and/or orientation tool system 700 shown in FIGS. 20-21.

At 802, one or more tools are locked into place with a lock ring. In this exemplary embodiment, the tools can be the operating tools 110-112 shown in FIGS. 6-10. The lock ring 146 shown in FIGS. 6-10 and/or the lock ring 318 shown in FIGS. 12-14.

At 803, the orientation tool system can be mounted on a toolstring. In some embodiments, the orientation tool system is connected to the toolstring by attaching a perforation gun to the toolstring or wire line. In such embodiments, the perforation gun is attached to an orientation sub, which attaches to a plug adapter. In this exemplary embodiment, the toolstring or wire line is the wire line 114 shown in FIGS. 6-10.

At 804, the orientation tool system can be inserted into a well. The insertion of the orientation tool system into the well can be done to bring operating tools, such as operating tools 110-112 shown in FIGS. 6-10, into a position that is in close proximity to their final position within the well.

At 805, the orientation tool system self-orients within the well, so that operating tools can perform the desired operations. The tool can be one or more of the operating tools 110-112 shown in FIGS. 6-10. The orientation sub is self-orienting, so that the orientation of the operating tools is driven by the geometry of the orientation sub and, more specifically, due to the distribution of mass (i.e., the relationship between the geometric center of the assembly and the center of mass of the assembly) within the orientation tool system.

At 806, the tool is utilized within the well. Once the tool is oriented in Step 805, the tool can perform operations. In this exemplary embodiment, the tool is a perforation gun that can be used to create openings in the wall of the well.

Supported Features and Embodiments

The detailed description provided above in connection with the appended drawings explicitly describes and supports various features of an orientation sub for well instruments. By way of illustration and not limitation, supported embodiments include an orientation sub for deployment within a well defined by casing, wherein the orientation sub and an offset operating tool form an offset tool assembly, and wherein the offset tool assembly connects to a centered tool assembly, the orientation sub comprising: an elongated tubular body for holding the tool within the well in a predetermined orientation when the offset tool assembly is deployed within the well, the elongated tubular body having a first tubular connecting section adapted to connect to a centered tool assembly, a second tubular connecting section adapted to connect to an offset operating tool, and a center section connecting the first tubular connecting section to the second tubular connecting section, wherein an outer diameter of the first tubular connecting section is substantially larger than an outer diameter of the second tubular connecting section, and wherein the center section has a predetermined geometric configuration that self-orients the offset operating tool when the offset tool assembly is inserted into the well.

Supported embodiments include the foregoing orientation sub, wherein an outer diameter of the first tubular connecting section is substantially larger than an outer diameter of the second tubular connecting section.

Supported embodiments include any of the foregoing orientation subs, wherein an outer diameter of the first tubular connecting section is substantially the same as an outer diameter of the second tubular connecting section.

Supported embodiments include any of the foregoing orientation subs, wherein the center section predetermined geometric configuration is an elliptic cylinder.

Supported embodiments include any of the foregoing orientation subs, wherein the center section predetermined geometric configuration is an offset tapered profile that lowers the center of mass of the offset tool assembly when the offset tool assembly is inserted into the well.

Supported embodiments include any of the foregoing orientation subs, wherein the second tubular connecting section is a male connector.

Supported embodiments include any of the foregoing orientation subs, wherein the second tubular connecting section is an essentially cylindrical member in electrical contact with the offset operating tool to facilitate the flow of electricity to the offset operating tool.

Supported embodiments include any of the foregoing orientation subs, wherein the centered tool assembly includes at least one of an adapter and a setting tool and wherein the first tubular connecting section is a female connector.

Supported embodiments include any of the foregoing orientation subs, wherein the centered tool assembly includes at least one of an adapter and a setting tool and wherein the first tubular connecting section is a male connector.

Supported embodiments include any of the foregoing orientation subs, wherein the first tubular connecting section is an essentially cylindrical member.

Supported embodiments include any of the foregoing orientation subs, further comprising a lock ring mounted on the elongated tubular body.

Supported embodiments include any of the foregoing orientation subs, wherein the tool is a perforation gun and the elongated tubular body includes a switch assembly therein.

Supported embodiments include any of the foregoing orientation subs, wherein the offset operating tool is selected from the group consisting of a swivel, a plug-shoot adapter, a wireline disconnect, a centralizer, a sensor, and a detector.

Supported embodiments include an apparatus, a system, a method, a kit, and/or means for implementing the foregoing orientation subs or a portion thereof.

Supported embodiments include a self-orienting orientation sub for orienting a tool when the tool is deployed in a well defined by casing, the orientation sub comprising: a pair of connectors consisting of a first connector and a second connector, a center section joining the first connector to the second connector, wherein the second connector connects the orientation sub to the tool, and wherein the center section has a predetermined geometric configuration that self-orients the tool when the orientation sub and the tool are inserted into the well.

Supported embodiments include the foregoing self-orienting orientation sub, wherein the first connector has an outer diameter that is substantially larger than an outer diameter of the second connector.

Supported embodiments include any of the foregoing self-orienting orientation subs, wherein the first connector has the same outer diameter as the outer diameter of the second connector.

Supported embodiments include any of the foregoing self-orienting orientation subs, wherein the center section predetermined geometric configuration is an elliptic cylinder.

Supported embodiments include any of the foregoing self-orienting orientation subs, wherein the center section predetermined geometric configuration is an offset tapered profile.

Supported embodiments include any of the foregoing self-orienting orientation subs, wherein the pair of connectors are essentially tubular members.

Supported embodiments include any of the foregoing self-orienting orientation subs, wherein the pair of connectors are essentially cylindrical.

Supported embodiments include any of the foregoing self-orienting orientation subs, wherein the second connector is in electrical contact with the tool.

Supported embodiments include any of the foregoing self-orienting orientation subs, further comprising a lock ring mounted on the center section.

Supported embodiments include any of the foregoing self-orienting orientation subs, wherein the tool is a perforation gun and wherein the center section has a switch assembly therein.

Supported embodiments include any of the foregoing self-orienting orientation subs, wherein the tool is selected from the group consisting of a swivel, a plug-shoot adapter, a wireline disconnect, a centralizer, a sensor, and a detector.

Supported embodiments include a system, a method, an apparatus, and/or means for implementing any of the foregoing self-orienting orientation subs or a portion thereof.

Supported embodiments can provide various attendant and/or technical advantages in terms of a perforation gun orientation device that orients perforations in the plane of weakness (at 0 degrees and 180 degrees) to result in a lower breakdown pressure and a more equal fluid distribution.

Supported embodiments include tooling assemblies that utilize perforation guns to cause the tool assemblies to have a lower center of gravity.

Supported embodiments include tooling assemblies that utilized offset perforation guns to lower the center of gravity without adding significant weight or length to the assembly. Additionally, such tooling assemblies produce a more accurate orientation of perforation guns.

Supported embodiments include an orientation system that can replace and supplement EWB, which become less effective at orienting as the gun lengthens.

Supported embodiments include an orientation device that shortens the gun string and becomes more effective at orienting as the gun string lengthens.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible.

The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. An offset tool assembly for deployment within a well defined by casing, wherein the offset tool assembly connects to a second tool assembly on a horizontal toolstring, the offset tool assembly comprising:

an orientation sub including an elongated tubular body having a first tubular connecting section, a second tubular connecting section, a center section having a predetermined geometric configuration for connecting the first tubular connecting section to the second tubular connecting section, a perforation gun connecting to the second tubular connecting section, a switch assembly within the elongated tubular body to supply electricity to the perforation gun, wherein the first tubular connecting section is adapted to connect to the second tool assembly, and wherein the second tubular connecting section holds the perforation gun in an offset position in relation to a geometric center of the horizontal toolstring to lower the center of gravity of the horizontal toolstring within a horizontal passage of the well to self-orient the offset tool assembly and to position the perforation gun adjacent to the lowest point of the well when the offset tool assembly is inserted into the well.

2. The offset tool assembly of claim 1, wherein the center section predetermined geometric configuration is an elliptic cylinder.

3. The offset tool assembly of claim 1, wherein the center section predetermined geometric configuration is an offset tapered profile.

4. The offset tool assembly of claim 3, wherein the second tubular connecting section is a male connector.

5. The offset tool assembly of claim 4, wherein the second tubular connecting section is an essentially cylindrical member in electrical contact with the perforation gun to facilitate the flow of electricity to the perforation gun.

6. The offset tool assembly of claim 3, wherein the second tool assembly includes at least one of an adapter and a setting tool and wherein the first tubular connecting section is a female connector.

7. The offset tool assembly of claim 3, wherein the second tool assembly includes at least one of an adapter and a setting tool and wherein the first tubular connecting section is a male connector.

8. The offset tool assembly of claim 7, wherein the first tubular connecting section is an essentially cylindrical member.

9. The offset tool assembly of claim 1, further comprising a lock ring mounted on the elongated tubular body.

10. An offset tool assembly for deployment within a well defined by casing on a horizontal toolstring, the offset tool assembly comprising:

a self-orienting orientation sub having a pair of connectors consisting of a first connector and a second connector and having a center section joining the first connector to the second connector, a perforation gun connecting to the second connector, a switch assembly within the self-orienting orientation sub to supply electricity to the perforation gun, wherein the center section has a predetermined geometric configuration that positions the perforation gun to self-orient the offset tool assembly to lower the center of gravity of the horizontal toolstring within a horizontal passage of the well and to position the perforation gun adjacent to the lowest point of the well when the offset tool assembly is inserted into the well.

11. The offset tool assembly of claim 10, wherein the center section predetermined geometric configuration is an elliptic cylinder.

12. The offset tool assembly of claim 10, wherein the center section predetermined geometric configuration is an offset tapered profile.

13. The offset tool assembly of claim 10, wherein the second connector is a male connector.

14. The offset tool assembly of claim 13, wherein the second connector is an essentially cylindrical member in electrical contact with the perforation gun to facilitate the flow of electricity to the perforation gun.

15. The offset tool assembly of claim 14, wherein the centered tool assembly includes at least one of an adapter and a setting tool and wherein the first connector is a female connector.

16. The offset tool assembly of claim 14, wherein the centered tool assembly includes at least one of an adapter and a setting tool and wherein the first connector is a male connector.

17. The offset tool assembly of claim 16, wherein the first connector is an essentially cylindrical member.

18. The offset tool assembly of claim 10, further comprising a lock ring mounted on the self-orienting orientation sub.

19. A new method for using a self-orienting tool assembly in a horizontal well defined by casing and having a wall, the method comprising:

connecting an orientation sub to a perforation gun to form an orientation tool system with the perforation gun being essentially adjacent to a lower surface of the orientation tool system to alter the distribution of mass of the orientation system to move the center of mass of the orientation system closer to the lower surface, mounting the orientation tool system on a toolstring, and inserting the orientation tool system into the horizontal well, so that the distribution of mass of the orientation tool system self-orients the orientation tool system within the horizontal well and positions the perforation gun adjacent to the lowest point of the horizontal well to increase the perforation efficiency of the perforation gun to create openings in the horizontal well wall.

20. The method of claim 19, wherein the self-orienting tool assembly is a first tool assembly for connecting to a second tool assembly on the toolstring, the method further comprising:

locking the orientation sub to the perforation gun and to the second tool assembly to hold the orientation of the perforation gun firmly before the orientation tool system is inserted into the horizontal well.

* * * * *